US007673598B2

(12) United States Patent
Schaefer et al.

(10) Patent No.: US 7,673,598 B2
(45) Date of Patent: Mar. 9, 2010

(54) ELECTRIC CAMSHAFT ADJUSTER

(75) Inventors: Jens Schaefer, Herzogenaurach (DE); Martin Steigerwald, Erlangen (DE); Jonathan Heywood, Pettstadt (DE)

(73) Assignee: Schaeffler KG, Herzogenaurach (DE)

( * ) Notice: Subject to any disclaimer, the term of this patent is extended or adjusted under 35 U.S.C. 154(b) by 367 days.

(21) Appl. No.: 10/598,318

(22) PCT Filed: Jan. 25, 2005

(86) PCT No.: PCT/EP2005/000672

§ 371 (c)(1),
(2), (4) Date: Sep. 12, 2006

(87) PCT Pub. No.: WO2005/080757

PCT Pub. Date: Sep. 1, 2005

(65) Prior Publication Data

US 2008/0210182 A1 Sep. 4, 2008

(30) Foreign Application Priority Data

Feb. 25, 2004 (DE) ..... 10 2004 009 128

(51) Int. Cl.
*F01L 1/34* (2006.01)

(52) U.S. Cl. ..... 123/90.15; 123/90.17; 464/160

(58) Field of Classification Search ..... 123/90.15, 123/90.16, 90.17, 90.18, 90.11; 464/160; 251/129.01, 129.11
See application file for complete search history.

(56) References Cited

U.S. PATENT DOCUMENTS 3,427,898 A 2/1969 Mayer
3,471,913 A 10/1969 Scott
3,789,700 A 2/1974 Cotreau et al.
5,417,186 A * 5/1995 Elrod et al. ..... 123/90.17
6,155,220 A 12/2000 Marriott
6,328,006 B1 * 12/2001 Heer ..... 123/90.15
7,144,468 B2 * 12/2006 Decristofaro et al. ..... 156/185

FOREIGN PATENT DOCUMENTS

AT 409 786 A 11/2002

(Continued)

*Primary Examiner*—Ching Chang
(74) *Attorney, Agent, or Firm*—Lucas & Mercanti, LLP

(57) ABSTRACT

The invention relates to an electric camshaft adjuster for adjusting and securing the phase angle of a camshaft of an internal combustion engine with respect to its crankshaft, having a three shaft gearing which is embodied as a harmonic drive (19, 19') of sleeve design, and a drive wheel (1) which is fixed to the crankshaft and has a first ring gear (2) as well as an output component (4) which is fixed to the camshaft and has a second ring gear (5) arranged next to the first ring gear (2) and an adjustment shaft (10, 10', 10", 10'") which can be driven by an electric adjustment motor, with a wave generator (17, 17', 17") which has means for elliptically deforming a flexurally elastic, externally toothed sleeve (18).

A way of improving a harmonic drive of sleeve design is for the expenditure on the construction of the harmonic drive (19, 19') to be lowered by changes to the wave generator (17, 17', 17"), and for the axial installation space thereof to be lowered by integrating the ring gears (2, 5) into the drive wheel (1) and output component (4) which are pushed axially one into the other.

19 Claims, 3 Drawing Sheets

FOREIGN PATENT DOCUMENTS

| | | | |
|---|---|---|---|
| DE | 195 20 555 | A | 12/1996 |
| DE | 197 08 310 | A | 9/1998 |
| DE | 100 45 054 | Y | 4/2001 |
| DE | 102 22 695 | A | 2/2003 |
| EP | 1 039 100 | X | 9/2000 |
| WO | 95/00748 | A | 1/1995 |

* cited by examiner

ELECTRIC CAMSHAFT ADJUSTER

FIELD OF THE INVENTION

The invention relates to an electric camshaft adjuster for adjusting and securing the phase angle of a camshaft of an internal combustion engine with respect to its crankshaft, having a drive wheel which is connected fixedly in terms of rotation to the crankshaft, an output component which is fixed to the camshaft, and a harmonic drive having at least one ring gear-spur gear pairing, one of the two components being connected fixedly in terms of rotation to the drive wheel, and the other component having at least a torque-transmitting connection to the output component, the spur gear being embodied as a flexurally elastic sleeve and being arranged at least partially within the first ring gear, having a wave generator which is driven by an electric adjustment motor by means of an adjustment shaft which is fixed to the gearing, which wave generator has means for elliptically deforming the flexurally elastic sleeve, as a result of which the sleeve is deformed in such a way that a torque-transmitting connection is formed between the ring gear and the sleeve at two points on the sleeve lying opposite one another.

BACKGROUND TO THE INVENTION

In electric camshaft adjusters, the low torque of the electric adjustment motor must be converted into a high torque which is necessary to adjust the camshaft. So-called three shaft gearings (summing gearings) are used for this purpose. Their drive is provided by means of a drive wheel which is fixed to the crankshaft and a drive shaft, while the power take off is carried out by means of an output shaft and a output component which is fixed to the camshaft. The adjustment power is input into the three shaft gearing in one direction or the other by the electric adjustment motor by means of an adjustment shaft.

Stringent requirements are made of the three shaft gearing. They are intended to have a high degree of efficiency so that the electric adjustment motor and its dissipated heat remain small. In addition, the tooth play of the toothings should be kept as small as possible since otherwise the highly varying alternating torque of the camshaft leads to undesired noises. This is all the more the case since the tooth edge play between the toothings of the adjustment shaft, drive shaft and output shaft is increased by the transmission ratio, thus promoting the generation of noise.

Furthermore it is necessary to minimize the installation space for the three shaft gearings since modern vehicle engines have to be made increasingly compact in order to comply with the safety-related minimum distance between the bodywork and the vehicle engine.

Finally, the three shaft gearing must be capable of being manufactured cost-effectively in order to keep the system costs for an electric camshaft adjuster with an adjustment gearing, adjustment motor and electronic actuation system low.

Possible three shaft gearings are double planetary gear mechanisms, double and single eccentric gear mechanisms and harmonic drives. In particular, the latter seem to be suitable for fulfilling the above requirements. In this context, two versions of the harmonic drive are known, specifically the harmonic drive of the pot design and that of the sleeve design.

EP 1 039 100 A2 and EP 1 039 101 A2 present harmonic drives of the pot design. This design requires a relatively large amount of axial installation space and due to the principle has axial thrust which requires corresponding bearings. Furthermore, with the pot design there is the risk of the wave generator tilting and jamming as a result of the toothing of the sleeve, especially since floating bearing thereof is virtually impossible because of its one-sided screw connection. The toothing of this design requires a special section which makes shaping manufacture difficult. Furthermore, instead of a cost-effective standard grooved ballbearing a costly thin ring bearing is necessary.

WO 95/00748 discloses a camshaft adjuster with a harmonic drive of a sleeve design. In this design there is no axial thrust since the tilting forces in the toothing of the sleeve compensate one another owing to the floating bearing of the wave generator and protect the wave generator against tilting and jamming. Furthermore, the sleeve design takes up comparatively little axial installation space. However, costly thin ring bearings are also used for the wave generator in the example above. In addition, the arrangement of the drive wheel, output component and ring gears requires considerable installation space in the above example.

OBJECT OF THE INVENTION

The invention is therefore based on the object of providing an electric camshaft adjuster with the smallest possible axial installation space and low structural complexity whose adjustment gearing is embodied as harmonic drive of sleeve design and whose manufacture is optimized in terms of weight and cost-effective.

SUMMARY OF THE INVENTION

The object is achieved according to the invention in that at least one of the gears of the ring gear-spur gear pairing is formed in one piece with the drive wheel or output component.

A further embodiment of the invention according to the invention achieves the object that the means for elliptically deforming the flexurally elastic sleeve are two bearing journals which are attached to the adjustment shaft and bear against two regions of the sleeve lying opposite one another, a roller bearing being arranged on each of said bearing journals.

The modification of the components relates to the wave generator and the sleeve, while the integration relates to the arrangement of the drive wheel and of the output component as well as the first and second ring gears.

The bearing of the drive wheel on the output component makes it possible to push one into the other. The bearing used for this purpose is a four point bearing. However, grooved ballbearings, cylindrical roller bearings or sliding bearings are also conceivable instead.

Forming the gear wheels of the harmonic drive in one piece with the drive wheel and/or output component of the camshaft adjuster reduces the number of components and thus the assembly costs. At the same time, the use of non-material-removing production techniques allows the production costs of the components to be lowered. In this context, non-material-removing shaping methods, applied to a blank of a suitable sheet steel, can be used just as well as stamped packetization. The toothings of the gear wheels can also be realized using these techniques.

Furthermore there is provision for the sleeve to be of pot-shaped design. The external lateral face of the flexurally elastic sleeve interacts with the internal lateral face of a ring gear in such a way that a torque-transmitting connection is produced between these faces.

The torque-transmitting connection between the ring gear and the sleeve can be implemented by means of an external toothing of the sleeve which engages in an internal toothing of the ring gear, the number of teeth of the internal toothing of the ring gear differing from the number of teeth of the external toothing of the sleeve.

A further possibility is the embodiment as a pair of friction wheels. In this case, the torque-transmitting connection between the ring gear and the sleeve is implemented in a frictionally locking fashion by means of the interaction of a smooth internal lateral face of the ring gear and a smooth external lateral face of the sleeve.

In order to improve the function there is also provision for the faces which enter into contact to be provided with friction linings.

The step down gearing of the harmonic drive is implemented by means of the small difference in number of teeth or the small difference between the radii of the ring gear and of the sleeve. The sleeve is directly connected to the camshaft by means of the base which extends radially inward from one axial end of the sleeve. The connection can be implemented by means of a screw or positively locking elements.

As an alternative to the embodiment in pot form there is provision that a second ring gear is arranged in the axial direction next to the first ring gear and coaxially with respect thereto, the sleeve is arranged at least partially within the second ring gear and enters into a torque-transmitting connection with the second ring gear at two points lying opposite one another.

There is provision here for the sleeve to be at least partially provided with a toothing in the axial direction and for at least one ring gear to be provided with a toothing. The toothings engage one in the other in the regions of the two points of intersection of the circumference of the ellipse with the main axis of the ellipse, as a result of which a torque-transmitting connection is produced. The second spur gear-ring gear pairing can be embodied as a friction wheel pairing or also as a gear wheel pairing.

There are advantages for simple and low-wear feeding of current if the electric adjustment motor is preferably embodied as a brushless DC motor (BLDC motor) which is operated in bipolar fashion with rare earth permanent magnets and a stator fixed to the cylinder head. However it is also conceivable to use a DC motor with brushes or an asynchronous motor and an electrical motor with a circumferential stator.

Since the wave generator is floating-mounted in the toothing of the harmonic drive it is necessary for the motor shaft of the BLDC motor and the adjustment shaft to have a connection by means of a rotationally fixed but radially movable or resilient coupling, which is embodied, for example, as a polymer coupling.

One advantageous development of the invention consists in the toothings of the harmonic drive having a profile shift. This is necessary since the toothing of the sleeve and the toothings of the first and second ring gears must intermesh with one another and they both have a different number of teeth but the same internal diameter matching the sleeve.

One advantageous variant of the harmonic drive according to the invention is characterized in that the transmission stage is embodied as a friction wheel gearing which has smooth faces instead of the toothings of the ring gear and of the associated part of the sleeve. In this way, the fabrication of the toothing of the 1:1 coupling stage is simplified and the running noise as well as the wear are reduced.

There are advantages if a stop ring is attached to the drive wheel and has a lug which engages in a corresponding, annular-segment-shaped cut-out, which limits the adjustment angle, of the output component. This applies in particular to the friction gearing version in which an assignment of the friction wheels with precise angles is not ensured.

It is also advantageous if a securing ring whose external diameter corresponds at least to the tooth head diameter of the first ring gear is pressed into the latter in such a way that it bears axially against its toothing. The securing ring serves for axially securing the adjustment shaft, wave generator and sleeve.

The dynamics of the camshaft adjustment are increased by virtue of the fact that at least the adjustment shaft has cut-outs for the purpose of reducing the weight and/or is composed of lightweight metal, plastic or a composite material. In addition there is provision for at least one of the toothing components, but possibly also all the toothing components, to be composed of lightweight metal, plastic or a composite material in order to reduce the weight.

Fabrication advantages for the harmonic drive are obtained if the components thereof are fabricated in an unhardened and non-material-removing fashion and at least the toothing is subsequently hardened or nitrated. In this way, the sleeve can be fabricated by drawing. It is also conceivable for the ring gears to be manufactured by stamped packetization.

A wave ring with an elliptical external circumference and an elliptically deformed roller bearing attached thereto are provided as means for elliptically deforming the flexurally elastic sleeve. In the embodiment of the harmonic drive with the toothed spur gear there is provision for the external ring of the roller bearing and the externally toothed sleeve to be embodied in one piece, as a result of which the number of components and thus the assembly costs can be reduced. Grooved ballbearings, roller bearings or needle bearings are possible as roller bearings. However, sliding bearings are also conceivable.

Furthermore there is provision for the elliptical wave ring and the internal ring of the roller bearing to be embodied in one piece. If the elliptical surface of the wave generator serves as a running face for the roller bearings, the internal ring of the standard roller bearing can also be dispensed with. The need for a further component of the harmonic drive is thus avoided.

A further embodiment of the invention according to the invention provides for the use of two bearing journals which are attached to the adjustment shaft and bear against two regions of the sleeve which lie opposite one another, said bearing journals being provided as means for elliptically deforming the flexurally elastic sleeve, instead of a solid or hollow shaft. As a result the weight of the camshaft adjuster, especially the weight of rotating components and thus the moment of inertia, are significantly reduced.

In order to minimize the friction, a roller bearing is arranged on each bearing journal. The internal ring of the roller bearing is supported on the bearing journal, while the sleeve is supported on the external ring. If the adjustment shaft and the drive wheel rotate at different rotational speeds, the external ring of the roller bearing rolls on the internal lateral face of the sleeve.

In one advantageous embodiment of the invention, the bearing journals are rotatably attached to the adjustment shaft using an eccentric fastening means and can be secured thereto in any desired rotational angle position. By means of this measure it is possible to easily set the play between the external toothing of the sleeve and the internal toothing of the ring gears.

Alternatively, in order to minimize the play between the external toothing of the sleeve and the internal toothing of the ring gears there is provision for the roller bearings to have eccentrically formed internal rings which can be pressed onto the bearing journals in any desired rotational angle position. This makes infinitely variable adjustment of the tooth play possible. However, it is also possible to provide adjustment shafts which have a stepped set value deviation of the distance between the bearing journals and the axis of the adjustment shafts in order to be installed using the selection method.

The two roller bearings can be embodied as ballbearings, preferably grooved ballbearings, cylindrical roller bearings or needle bearings. Due to the principle, the two standard roller bearings are not deformed during operation so that they are not subject to any additional loading. Compared to an elliptical wave generator, the sleeve is not supported over the entire circumference but rather only at the locations of tooth engagement.

BRIEF DESCRIPTION OF THE DRAWINGS

Further features of the invention are revealed from the following description and the drawings in which an exemplary embodiment of the invention is illustrated schematically. In the drawings.

DETAILED DESCRIPTION OF THE DRAWINGS

Figure 1:
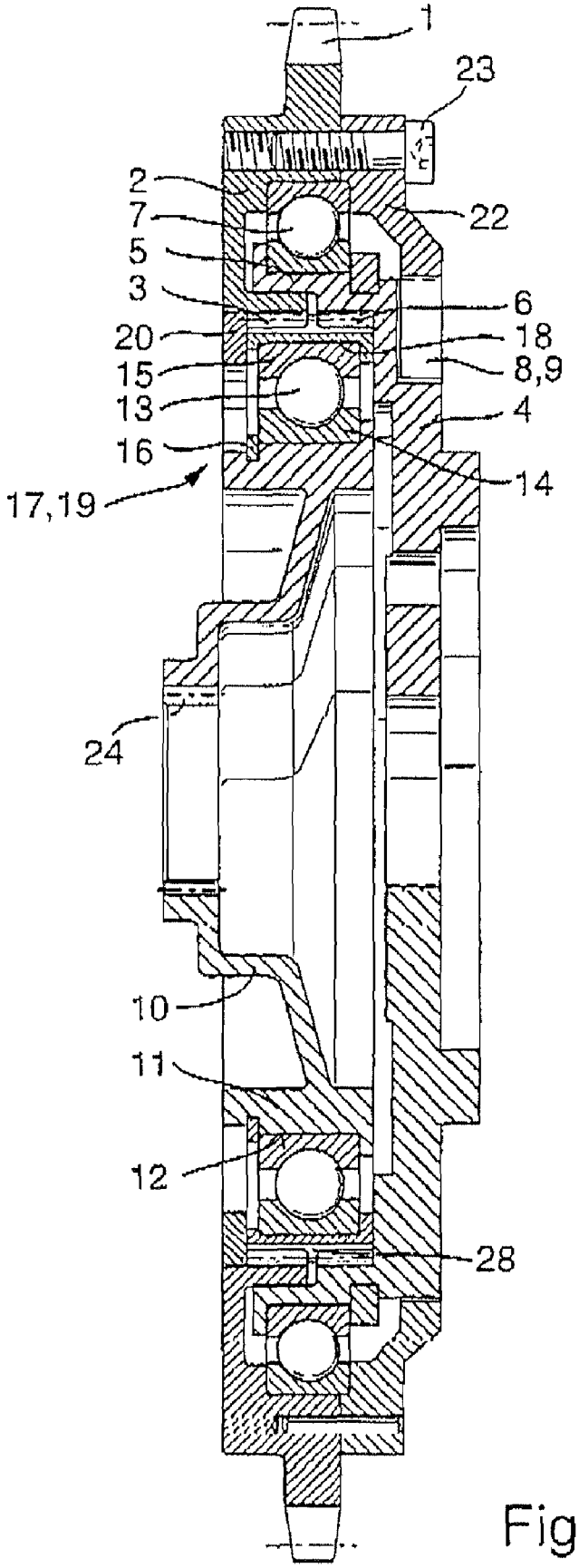
FIG. 1 shows a longitudinal section through a harmonic drive with a wave generator which has a standard grooved ballbearing.

FIG. 1 shows a longitudinal section through a camshaft adjuster according to the invention. The latter has a drive wheel 1 which is embodied as a chain wheel and is connected fixedly in terms of rotation to a crankshaft (not illustrated) via a chain (not illustrated). Of course, it is equally conceivable to embody the drive wheel 1 as a toothed belt wheel or spur gear which is driven by a toothed belt or a spur gear drive. The drive wheel 1 and a first ring gear 2 are embodied in one piece, the first ring gear 2 having a first internal toothing 3. An output component 4 which is embodied in one piece with a second ring gear 5 is connected fixedly in terms of rotation to a camshaft (not illustrated). The second ring gear 5 has a second internal toothing 6 and is arranged adjacent in the axial direction and coaxially with respect to the first ring gear 2. The drive wheel 1 is mounted, together with the first ring gear 2, by means of a four point bearing 7, which is arranged radially and axially within the drive wheel 1, on the camshaft (not illustrated) via the second ring gear 5 and the output component 4. The four point bearing can, as illustrated, be embodied as a separate component with the internal ring, roller bearings, cage and external ring. In a further advantageous embodiment, the roller bearing race ways are formed directly on the drive wheel 1 and the second ring gear 5, as a result of which the internal ring and the external ring of the roller bearing are eliminated and the number of components is reduced. Apart from the illustrated ballbearing, it is also possible to use needle bearings or roller bearings. A stop ring 22 is attached to the drive wheel 1 by means of screws 23, rivets, welded connections or caulking, for example. Said stop ring 22 has a lug 8 which engages in a corresponding annular-segment-shaped cut-out 9, which limits the adjustment angle, of the output component 4. Embodiments in which the cut-out 9 which limits adjustment angles is provided in the drive wheel 1 and in which an element which is connected fixedly in terms of rotation to the output component 4 engages are also conceivable.

An adjustment shaft 10 has a toothed coupling 24 for an electric adjustment motor (not illustrated). Of course, other couplings, such as polymer couplings or magnetic couplings, which can compensate axial and radial offset occurring between the gearing shaft and the electric motor shaft are of course also conceivable. The adjustment shaft 10 is connected to a wave ring 11 which has an elliptical external contour 12. A roller bearing 13 whose internal ring 14 and external ring 15 assume the elliptical shape of the wave ring 11 when said roller bearing 13 is pressed on is located on said wave ring 11. In addition to the illustrated ballbearing, preferably grooved ballbearing, other roller bearing designs, for example cylindrical roller bearings or needle bearings, are also conceivable. The roller bearing 13, which is secured axially by means of a circlip 16, forms, together with the elliptical wave ring 11, a wave generator 17 as part of the harmonic drive 19.

An elastic sleeve 18 with an external toothing 28 is pressed onto the external ring 15 of the roller bearing 13, the sleeve 18 also assuming the elliptical shape when pressed on. The sleeve 18 can be secured against shifting axially on the roller bearing 13 using positively locking means. This can be implemented, for example, by radially inwardly directed chamfering of the axial ends of the sleeve 18.

The wave generator 17 and the sleeve 18 are embodied in such a way that they can be arranged radially within the ring gears 2, 5. The wave generator 17 bears axially against the output component 4 here. In order to secure the sleeve 18 and the wave generator 17 axially, a securing ring 20 is pressed into the first ring gear 2 on the side facing away from the output component 4, the external diameter of which securing ring 20 corresponds at least to the diameter of the tooth base of the first ring gear 2 and bears against the internal toothing 3 thereof. The wave generator 17 and the sleeve 18 then bear in an axial direction between the output component 4 and the securing ring 20. The elliptically deformed sleeve 18 engages with its external toothing 28 in the regions of the two points of intersection of the elliptical circumference with the main axis of the ellipsis in the first and second external toothings 3, 6 of the ring gears 2, 5.

The internal toothing 3, 6 of each ring gear 2, 5 is therefore in engagement with the external toothing 28 of the sleeve 18 in two areas. The elliptical deformation of the sleeve 18 ensures that these areas are localized on the ring gear 2, 5 at locations lying opposite one another with respect to the center point of the respective ring gear 2, 5.

Figure 2:
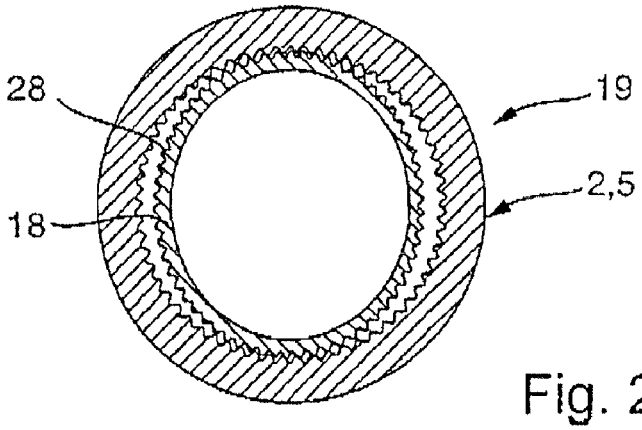
FIG. 2 is a view of a harmonic drive with ring gears and a flexible, externally toothed sleeve.

FIG. 2 shows the harmonic drive 19 with the sleeve 18 and the ring gears 2, 5 in a simplified side view. It is clearly apparent that the external toothing 28 of the elliptically deformed sleeve 18 engages in each case in two areas of the first and second internal toothings 3, 6 of the ring gears 2, 5. One of the ring gears 2, 5 has the same number of teeth as the sleeve 18, and the other ring gear 2, 5 has, for example, two teeth more. Shifting the profile permits the external toothing 28 of the elliptical sleeve 18 to simultaneously be in engagement with both ring gears 2, 5 despite their different number of teeth, specifically at locations thereon lying opposite one another. The ring gear 2 or 5 with the same number of teeth as the sleeve 18 acts as a 1:1 tooth coupling, and the ring gear 2 or 5 with the higher number of teeth acts as a transmission stage. Which of the two ring gears 2 or 5 has the same number of teeth and which has the higher number of teeth depends on the direction in which the harmonic drive 19 is to be adjusted when the adjustment shaft 10 is stationary, i.e. whether it is intended to function as a positive gearing or as a negative gearing. It is also conceivable for the number of teeth of all the toothings 3, 6 and 28 to differ. In this way, the size of the profile shift on a toothing 3, 6 and 28 can be reduced to a minimum. It is likewise conceivable to embody the external toothing 28 of the sleeve 18 as divided external toothing, one part of the toothing engaging in the first internal toothing 3, and the second part of the toothing engaging in the second internal toothing 6. The two external toothings may be of differing design. Examples of this are the number of teeth or tooth module. In this way it is possible for the profile shifts to be reduced or for different modules to be used for better load-bearing capacity.

The drive wheel 1, which is embodied in one piece with the first ring gear 2, the output component 4, which is embodied in one piece with the second ring gear 5, and the sleeve 18 are preferably manufactured using non-material-removing shaping methods. The use of non-material-removing techniques reduces both the weight of the individual components and their manufacturing costs in mass production. The individual components including the toothings 3, 6, 28 can advantageously be manufactured from sheet steel using a non-material-removing shaping method. It is also conceivable to manufacture the components by means of stamped packetization.

The harmonic drive 19 according to FIGS. 1 and 2 functions in the following way: when the adjustment shaft 10 rotates, the wave generator 17 also makes one rotation. Here, the external toothing 28 of the elliptical sleeve 18 is made to roll simultaneously on the internal toothings 3, 6 of the first and second ring gears 2, 5.

If the first ring gear 2 has the same number of teeth as the elliptical sleeve 18, the initial tooth on the sleeve 18 engages again in its initial tooth gap after one rotation of the adjustment shaft 10. The position of the sleeve 18 has thus not changed with respect to the first ring gear 2 and a 1:1 tooth coupling is present.

If the second internal toothing 6 of the second ring gear 5 has, for example, two teeth more than the external toothing 28 of the sleeve 18, the initial tooth of the sleeve 18 engages, after one rotation of the adjustment shaft 10, in a tooth gap of the second ring gear 5 which lies two tooth gaps before the original one. As a result, the sleeve 18 remains two teeth behind per rotation of the adjustment shaft 10 so that the sleeve 18 rotates in the opposite direction to the adjustment shaft 10 with the ratio of the overall number of teeth of the second ring gear 5 (for example 300 teeth) to the differential number of teeth (that is to say 300:2=150:1), i.e. has a step-down transmission ratio of 150:1.

In a further advantageous embodiment of the invention, the spur gear-ring gear pairing which is responsible for the step-down transmission ratio is embodied as a friction wheel pairing, while the other spur gear-ring gear pairing interacts by means of toothings and is preferably embodied as a 1:1 coupling. The external toothing 28 of the sleeve 18 extends in the axial direction only in the area in which the sleeve 18 lies within the other ring gear 2 or 5. The other area is of a smooth design and interacts with the internal lateral face of the corresponding ring gear 2 which is also smooth. Both the toothings 6, 28 of the first spur gear-ring gear pairing and the smooth faces of the second spur gear-ring gear pairing respectively interact at two areas lying opposite one another, owing to the elliptically deformed sleeve 18.

A further embodiment of the invention provides just one spur gear-ring gear pairing. It is in turn conceivable to transmit torque by means of toothings 2, 28 or frictional engagement. The drive wheel 1 is embodied in one piece with the ring gear 2. The sleeve 18 is of pot-shaped design, with the camshaft being attached fixedly in terms of rotation to its base.

Figures 3A, 3B, 3C:
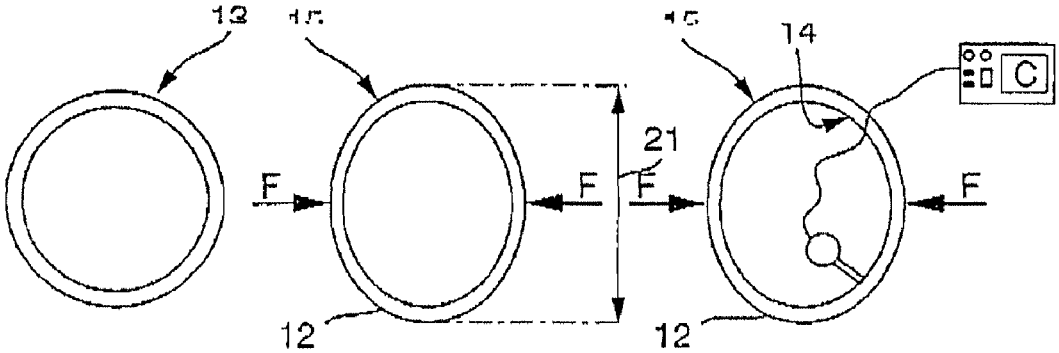
FIG. 3*a* shows an undeformed roller bearing of the sleeve.
FIG. 3*b* shows a roller bearing of the sleeve which is deformed to the desired degree of ellipsis.
FIG. 3*c* shows measurement of the internal ring of the roller bearing of the sleeve.

The geometry of the ellipse of the wave generator 17 can be determined according to FIGS. 3*a*, 3*b*, 3*c*:

FIG. 3*a* illustrates a non-deformed standard roller bearing 13.

In FIG. 3*b*, the standard roller bearing 13 is compressed at two locations lying opposite one another on the external ring 15 in the direction of the arrow F until the desired maximum degree of ellipsis 21 on the external ring 15 is reached.

In FIG. 3*c*, the elliptical internal contour of the internal ring 14 is measured and if appropriate corrected, after which the elliptical external contour 12 of the wave ring 11 of the wave generator 17 is manufactured.

Figure 4:
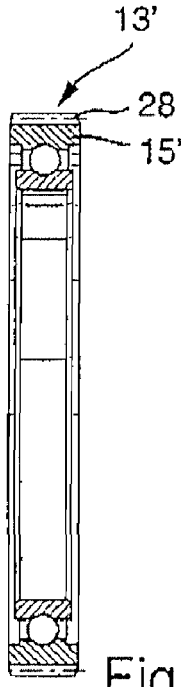
FIG. 4 shows a longitudinal section through a standard grooved ballbearing with toothed external ring.

FIG. 4 shows a longitudinal section through a further embodiment of a roller bearing 13' which is embodied as a grooved ballbearing whose external ring 15' has the external toothing 28 of the sleeve 18, and can thus take its place. The omission of the sleeve 18 of course has the effect of reducing costs.

Figure 5:
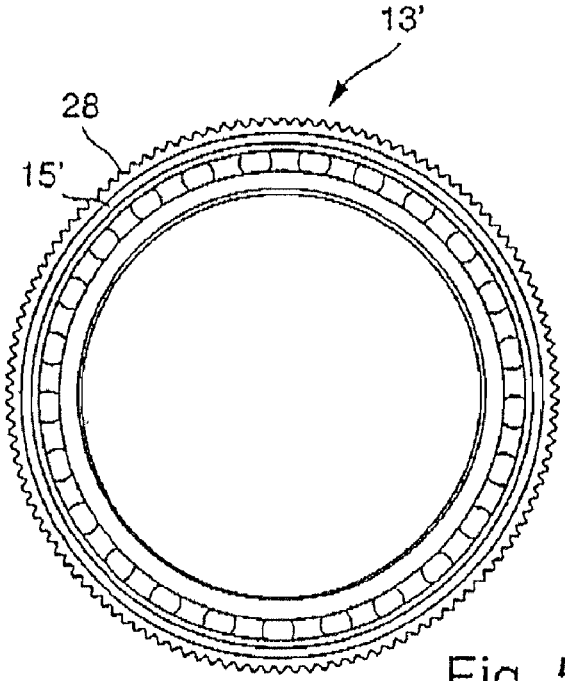
FIG. 5 shows a view of the standard grooved ballbearing from FIG. 4.

FIG. 5 shows a front view of the roller bearing 13' from FIG. 4 with the external toothing 28 which is embodied in one piece with the external ring 15'.

Figure 6:
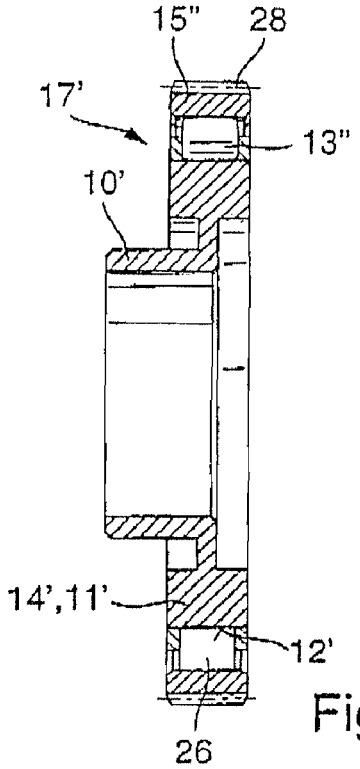
FIG. 6 shows a longitudinal section through an adjustment shaft with a wave generator.

FIG. 6 shows a longitudinal section through a wave generator 17' with an adjustment shaft 10' and an external toothing 28. The wave generator 17' has a wave ring 11' and a roller bearing 13" which is embodied as a cylindrical roller bearing. The cylindrical roller bearing is composed of a plurality of cylindrical rollers 26 which are arranged between an internal ring 14' and an external ring 15" and roll on the roller bearing rings 14', 15" when there are relative movements between said roller bearing rings 14', 15". The internal ring 14' is embodied in one piece with the wave ring 11'. The cylindrical rollers 26 of the roller bearing 13" run directly on the elliptical external contour 12' of the correspondingly enlarged wave ring 11'. The external toothing 28 is formed directly on the external ring 15" of the roller bearing 13". Since, compared to the first embodiment, the cyclical deformation of the internal ring 14' and of the sleeve 18 is eliminated, the power of the electric adjustment motor can be correspondingly smaller.

Figure 7:
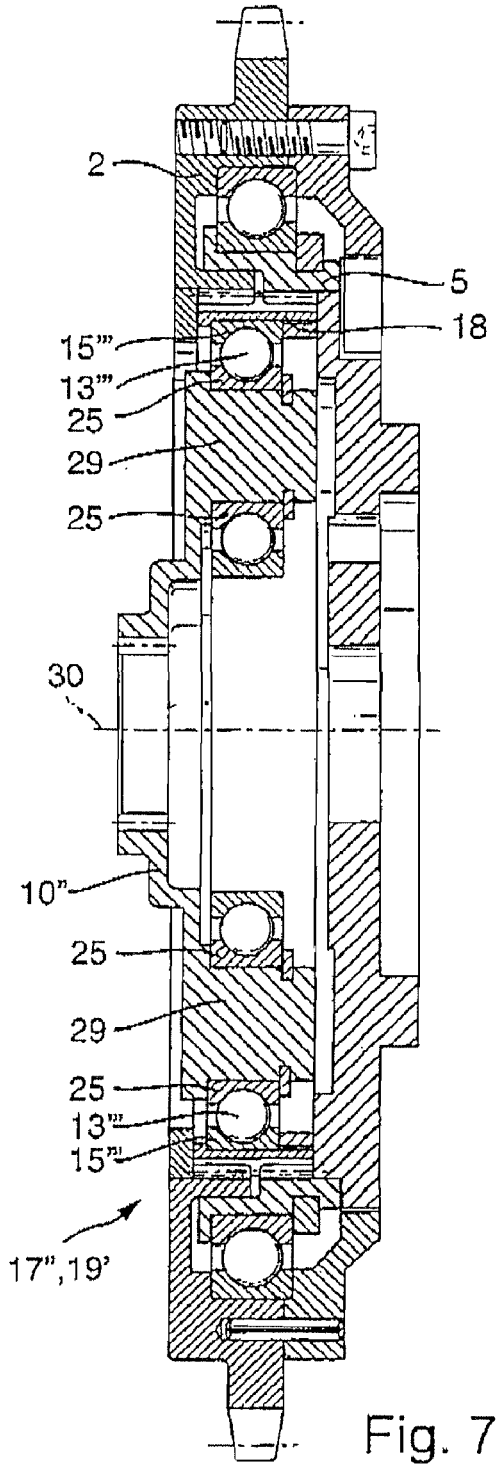
FIG. 7 shows a longitudinal section through a variant of the harmonic drive in FIG. 1 with a modified adjustment shaft.

FIG. 7 shows a longitudinal section through a harmonic drive 19', a variant of the harmonic drive 19 from FIG. 1, having a modified wave generator 17". Here, an adjustment shaft 10" has, instead of a wave ring, two axial bearing journals 29 with two standard roller bearings 13'" which are formed as grooved ballbearings. The internal rings 25 of the standard roller bearings 13'" are seated fixedly on the bearing journals 29, while the sleeve 18 is supported on the external rings 15'". The bearing journals 29 are offset by 180° and are arranged at the same distance from the axle 30 of the adjustment shaft 10". The distance is selected such that the sleeve 18 is deformed elliptically in the same way as by the wave ring 11 in FIG. 1.

In order to minimize tooth play, the internal rings 25 of the roller bearings 13'" can be embodied as eccentric internal rings 25. By installing them with a corresponding rotational angle position it is possible to set the tooth play between the teeth of the sleeve 18 and of the ring gears 2, 5.

Figure 8:
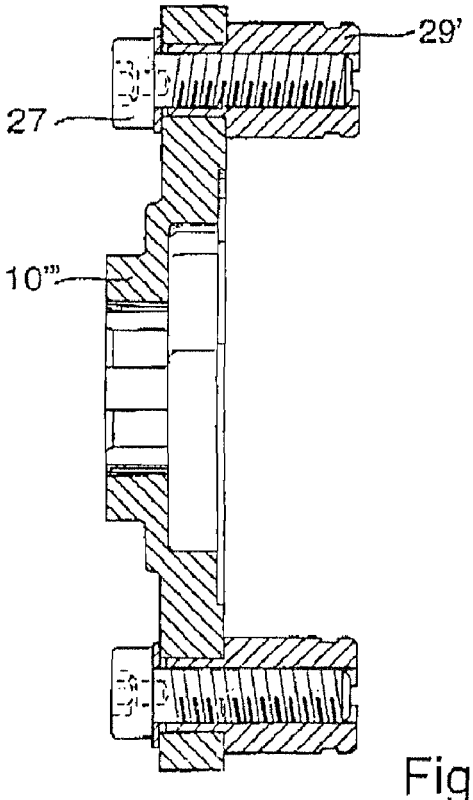
FIG. 8 shows a longitudinal section through a camshaft adjuster with a third embodiment of an adjustment shaft.

This objective is also served by the multi-component adjustment shaft 10''' (illustrated in FIG. 8) whose eccentrically formed axial bearing journals 29' can be attached in any desired rotational angle position by means of tensioning screws 27.

In a further embodiment, the internal rings 25 of the roller bearings 13''' are embodied in one piece with the bearing journals 29, 29', i.e. the race ways of the roller bearings are formed in the external lateral face of the bearing journals 29, 29'.

LIST OF REFERENCE NUMERALS

1 Drive wheel
2 First ring gear
3 First internal toothing
4 Output component
5 Second ring gear
6 Second internal toothing
7 Four point bearing
8 Lug
9 Cut-out
10, 10', 10'', 10''' Adjustment shaft
11, 11' Wave ring
12, 12' Elliptical external contour
13, 13', 13'', 13''' Roller bearing
14, 14' Internal ring
15, 15', 15'', 15''' External ring
16 Circlip
17, 17', 17'' Wave generator
18 Sleeve
19, 19' Harmonic drive
20 Securing ring
21 Maximum degree of ellipsis
22 Stop ring
23 Screw
24 Tooth coupling
25 Eccentric internal ring
26 Cylindrical roller
27 Tensioning screw
28 External toothing
29, 29' Axial bearing journal
30 Axis

The invention claimed is:

1. An electric camshaft adjuster for adjusting and securing a phase angle of a camshaft of an internal combustion engine with respect to a crankshaft, comprising:

a drive wheel which is connected fixedly in terms of rotation to the crankshaft, an output component which is fixed to the camshaft, a harmonic drive having at least one ring gear-spur gear pairing, the at least one ring gear-spur gear pairing having a first ring gear directly connected fixedly in terms of rotation to the drive wheel and a spur gear having at least a torque-transmitting connection to the output component, the spur gear being embodied as an elastic sleeve and arranged at least partially within the first ring gear, and a wave generator which is driven by an electric adjustment motor by means of an adjustment shaft which is fixed to the wave generator, the wave generator has means for elliptically deforming the elastic sleeve, causing a torque-transmitting connection to form between the first ring gear and the elastic sleeve at two points on the elastic sleeve lying opposite one another, wherein the first ring gear is formed in one piece with the drive wheel or the output component.

2. An electric camshaft adjuster for adjusting and securing a phase angle of a camshaft of an internal combustion engine with respect to a crankshaft, comprising:

a drive wheel which is connected fixedly in terms of rotation to the crankshaft, an output component which is fixed to the camshaft, a harmonic drive having at least one ring gear-spur gear pairing, the at least one ring gear-spur gear pairing having a first ring gear connected fixedly in terms of rotation to the drive wheel, and a spur gear having at least a torque-transmitting connection to the output component, the spur gear being embodied as an elastic sleeve and arranged at least partially within the first ring gear, and a wave generator which is driven by an electric adjustment motor by means of an adjustment shaft which is fixed to the wave generator, the wave generator has means for elliptically deforming the elastic sleeve, causing a torque-transmitting connection to form between the first ring gear and the elastic sleeve at two points on the elastic sleeve lying opposite one another, wherein the means for elliptically deforming the elastic sleeve is two bearing journals which are radially disposed opposite each other, are attached to the adjustment shaft and bear against two regions of the elastic sleeve lying opposite one another, a roller bearing being arranged on each of said bearing journals.

3. The camshaft adjuster according to one of claims 1 or 2, wherein the elastic sleeve is of pot-shaped design.

4. The camshaft adjuster according to one of claims 1 or 2, wherein a second ring gear is arranged in the axial direction next to the first ring gear and coaxially with respect thereto, the elastic sleeve is arranged at least partially within the second ring gear and enters into a torque-transmitting connection with the second ring gear at two points lying opposite one another.

5. The camshaft adjuster according to one of claims 1 or 2, wherein the torque-transmitting connection between the first ring gear and the elastic sleeve is implemented by means of an external toothing of the elastic sleeve which engages in an internal toothing of the first ring gear, and the number of teeth of the internal toothing of the first ring gear differs from the number of teeth of the external toothing of the elastic sleeve.

6. The camshaft adjuster according to one of claims 1 or 2, wherein the torque-transmitting connection between the first ring gear and the elastic sleeve is implemented in a frictionally locking fashion by means of the interaction of the smooth internal lateral face of the first ring gear and the smooth external lateral face of the elastic sleeve.

7. The camshaft adjuster according to one of claims 1 or 2, wherein the electric adjustment motor is a brushless DC motor (BLDC motor) which is operated in bipolar fashion and has a stator fixed to the cylinder head and a rare earth magnet.

8. The camshaft adjuster according to claim 7, wherein a motor shaft of the BLDC motor and the adjustment shaft are connected by means of a rotationally fixed but radially movable or resilient coupling, which is embodied as a polymer coupling.

9. The camshaft adjuster according to one of claims 1 or 2, wherein a stop ring is attached to the drive wheel and has a lug which engages in a corresponding, annular-segment-shaped cut-out, which limits the adjustment angle, of the output component.

10. The camshaft adjuster according to one of claims 1 or 2, wherein a securing ring, whose external diameter corresponds at least to the tooth head diameter of the first ring gear, can be pressed into the tooth head diameter of the first ring gear.

11. The camshaft adjuster according to one of claims 1 or 2, wherein at least the adjustment shaft can have cut-outs for the purpose of reducing the weight.

12. The camshaft adjuster according to claim 5, wherein the harmonic drive is fabricated in a non-material-removing fashion, and the toothings are subsequently hardened or nitrated.

13. The camshaft adjuster according to claim 5, wherein the means for elliptically deforming the elastic sleeve is a wave ring with an elliptical external circumference and an elliptically deformed roller bearing attached thereto, and an external ring of the roller hearing and the elastic sleeve are embodied in one piece.

14. The camshaft adjuster according to one of claims 1 or 2, wherein the harmonic drive is fabricated in a non-material-removing fashion.

15. The camshaft adjuster according to claim 1, wherein the means for elliptically deforming the elastic sleeve is a wave ring with an elliptical external circumference and an elliptically deformed roller bearing attached thereto.

16. The camshaft adjuster according to claim 15, wherein the elliptical wave ring and the internal ring of the roller bearing are embodied in one piece.

17. The camshaft adjuster according to claim 2, wherein the bearing journals are rotatably attached to the adjustment shaft using an eccentric fastening means and can be secured in a desired rotational angle position.

18. The camshaft adjuster according to claim 2, wherein the roller bearings have eccentrically formed internal rings which can be pressed onto the bearing journals in a desired rotational angle position.

19. The camshaft adjuster according to one of claims 1 or 2, wherein all or some of the camshaft adjuster components are manufactured by means of stamped packetization.

* * * * *